US007758046B2

(12) United States Patent
Moats

(10) Patent No.: US 7,758,046 B2
(45) Date of Patent: Jul. 20, 2010

(54) AUTO RACING BOARD GAME

(76) Inventor: Carrie Moats, 1908 Lowell St., Granger, IA (US) 50109

( * ) Notice: Subject to any disclaimer, the term of this patent is extended or adjusted under 35 U.S.C. 154(b) by 20 days.

(21) Appl. No.: 12/147,658

(22) Filed: Jun. 27, 2008

(65) Prior Publication Data

US 2009/0322027 A1 Dec. 31, 2009

(51) Int. Cl.
*A63F 3/00* (2006.01)

(52) U.S. Cl. ..... 273/246; 273/237

(58) Field of Classification Search ..... 273/237, 273/246–251

See application file for complete search history.

(56) References Cited

U.S. PATENT DOCUMENTS 7,261,296 B1 * 8/2007 Duncan ..... 273/246
2006/0281507 A1 * 12/2006 Adams ..... 463/6

* cited by examiner

*Primary Examiner*—Vishu K. Mendiratta
(74) *Attorney, Agent, or Firm*—Michael Ries

(57) ABSTRACT

Disclosed is an auto racing board game comprising a foldable planar member, a plurality of toy cars, and at least one die. The foldable planar member comprises a race track imprinted thereon. The race track comprises a plurality of lanes, each of the plurality of lanes divided into a plurality of move spaces. One or more of the plurality of move spaces in each of the plurality of lanes is colored in a color of a plurality of distinct colors. The foldable planar member further comprises at least one speaker operatively coupled to a plurality of distinct colored buttons, the at least one speaker adapted to produce a distinct sound upon pressing each of the plurality of distinct colored buttons. Moreover, the foldable planar member comprises a microcontroller operatively coupled to the at least one speaker and to each of the plurality of distinct colored buttons.

10 Claims, 2 Drawing Sheets

AUTO RACING BOARD GAME

FIELD OF THE INVENTION

The present invention relates to a board game, and more particularly to an auto racing board game for a plurality of players.

BACKGROUND OF THE INVENTION

These days, due to hectic life styles, people seldom find time to spend with friends and families thereof. In order to spend a quality time together, people may prefer to play indoor and outdoor games. These indoor and outdoor games bring people together and add a lot of fun to their life. Usually, members of a family prefer to play indoor games as the indoor games are easy to play, and are easily available.

Indoor games such as board games have been a popular source of recreation and entertainment, for young and old alike, for many generations. The popularity of the board games may also be attributed to fun and competition that the board games provide when people play a game thereon. For example, members of a family may pose as players playing an auto racing board game, thereby competing amongst themselves for winning a game in the auto racing board game. Accordingly, such board games offer a competition among the family members playing the game. Moreover, such auto racing board games allow members of a family to spend time together while playing the game.

Although the board games such as an auto racing board game allow people to have a lot of fun, such board games may become monotonous after some time. More specifically, conventional board games lack liveliness and are unable to add excitement to the game. Moreover, conventional board games are expensive since such games are sold with a plurality of racing elements, such as racing toy cars therewithin. However, inclusion of a plurality of racing cars within the board game may increase the overall cost of the auto racing board game.

Accordingly, there is a need for an auto racing board game that may prevent the auto racing board game from becoming monotonous after some time and may be able to add excitement to the auto racing board game while playing the same. Further, there is a need for an auto racing board game that is cost effective. Furthermore, there is a need for an auto racing board game that may give flexibility to players to play with their own racing elements that are not a part of the auto racing board game.

SUMMARY OF THE INVENTION

In view of the foregoing disadvantages inherent in the prior art, the general purpose of the present invention is to provide an auto racing board game to include all the advantages of the prior art, and to overcome the drawbacks inherent therein.

An object of the present invention is to provide an auto racing board game that may eliminate monotonous nature of the auto racing board game, thereby adding excitement to the auto racing board game.

Another object of the present invention is to provide an auto racing board game that is cost effective.

Yet another object of the present invention is to provide an auto racing board game that gives flexibility to players to play with such racing elements that are not a part of the auto racing board game.

In light of the above objects, in one aspect of the present invention, an auto racing board game for a plurality of players is disclosed. The auto racing board game comprises a foldable planar member. The foldable planar member comprises a race track imprinted thereon. The race track comprises a plurality of lanes such that each of the plurality of lanes is divided into a plurality of move spaces. The one or more of the plurality of move spaces in each of the plurality of lanes is colored in a color of a plurality of distinct colors. The foldable planar member further comprises a plurality of distinct colored buttons corresponding to the plurality of distinct colored move spaces. The plurality of distinct colored buttons is configured on a first peripheral edge of the foldable planar member. The foldable planar member further comprises at least one speaker operatively coupled to the plurality of distinct colored buttons. The at least one speaker is adapted to produce a distinct sound upon pressing each of the plurality of distinct colored buttons. The foldable planar member further comprises a microcontroller operatively coupled to the at least one speaker and to each of the plurality of distinct colored buttons. The microcontroller is adapted to activate the at least one speaker upon pressing each of the plurality of distinct colored buttons. Furthermore, the auto racing board game comprises a plurality of toy cars representing the plurality of players. The plurality of toy cars is capable of being shifted on the plurality of move spaces. The auto racing board game further comprises a dice for generating a random number. The random number represents a number of move spaces of the plurality of move spaces, such that at least one toy car of the plurality of toy cars is shifted by the number of move spaces on at least one lane of the plurality of lanes.

In another aspect of the present invention, a method for playing the auto racing board game is disclosed. The method comprises providing a foldable planar member. The foldable planar member comprises a race track imprinted on the foldable planar member. The race track comprises a plurality of lanes such that each of the plurality of lanes is divided into a plurality of move spaces, wherein one or more of the plurality of move spaces in each of the plurality of lanes is colored in a color of a plurality of distinct colors. The foldable planar member further comprises a plurality of distinct colored buttons corresponding to the plurality of distinct colored move spaces. The plurality of distinct colored buttons is configured on a first peripheral edge of the foldable planar member. Further, the foldable planar member comprises at least one speaker operatively coupled to the plurality of distinct colored buttons. The at least one speaker is adapted to produce a distinct sound upon pressing each of the plurality of distinct colored buttons. Furthermore, the foldable member comprises a microcontroller operatively coupled to the at least one speaker and to each of the plurality of distinct colored buttons. The microcontroller is adapted to activate the at least one speaker upon pressing each of the plurality of distinct colored buttons.

The method of playing on the auto racing board game further comprises providing a plurality of toy cars capable of being shifted on the race track. Each of the plurality of toy cars represents a player of the plurality of players. The method further includes providing a dice for generating a random number. The random number represents a number of move spaces of the plurality of move spaces, such that, the at least one toy car of the plurality of toy cars is shifted by the number of move spaces on at least one lane of the plurality of lanes. The method further comprises following a set of instructions, taking turn, by each of the plurality of players for determining a winner of the auto racing board game. The set of instructions comprises rolling the dice by a player of the plurality of players for generating a random number, shifting a toy car representing the player by the number of move spaces on the at least one lane, pressing a distinct colored button corresponding to the distinct colored move space as the toy car arrives at the corresponding distinct colored move space, and determining the winner of the auto racing board game based on a predetermined number of laps completed by a toy car of the plurality of toy cars around the race track.

DETAILED DESCRIPTION OF THE INVENTION

The present invention provides an auto racing board game. The auto racing board game may be played by a plurality of players. Each of the plurality of players is represented by a toy car of a plurality of toy cars. The plurality of player may compete amongst themselves for winning the auto racing board game. The auto racing board game may add a lot of fun, enthusiasm and excitement to the game as the auto racing board game is colorful and capable of producing a variety of sounds at appropriate instances while the plurality of player are playing the auto racing board game.

Figure 1:
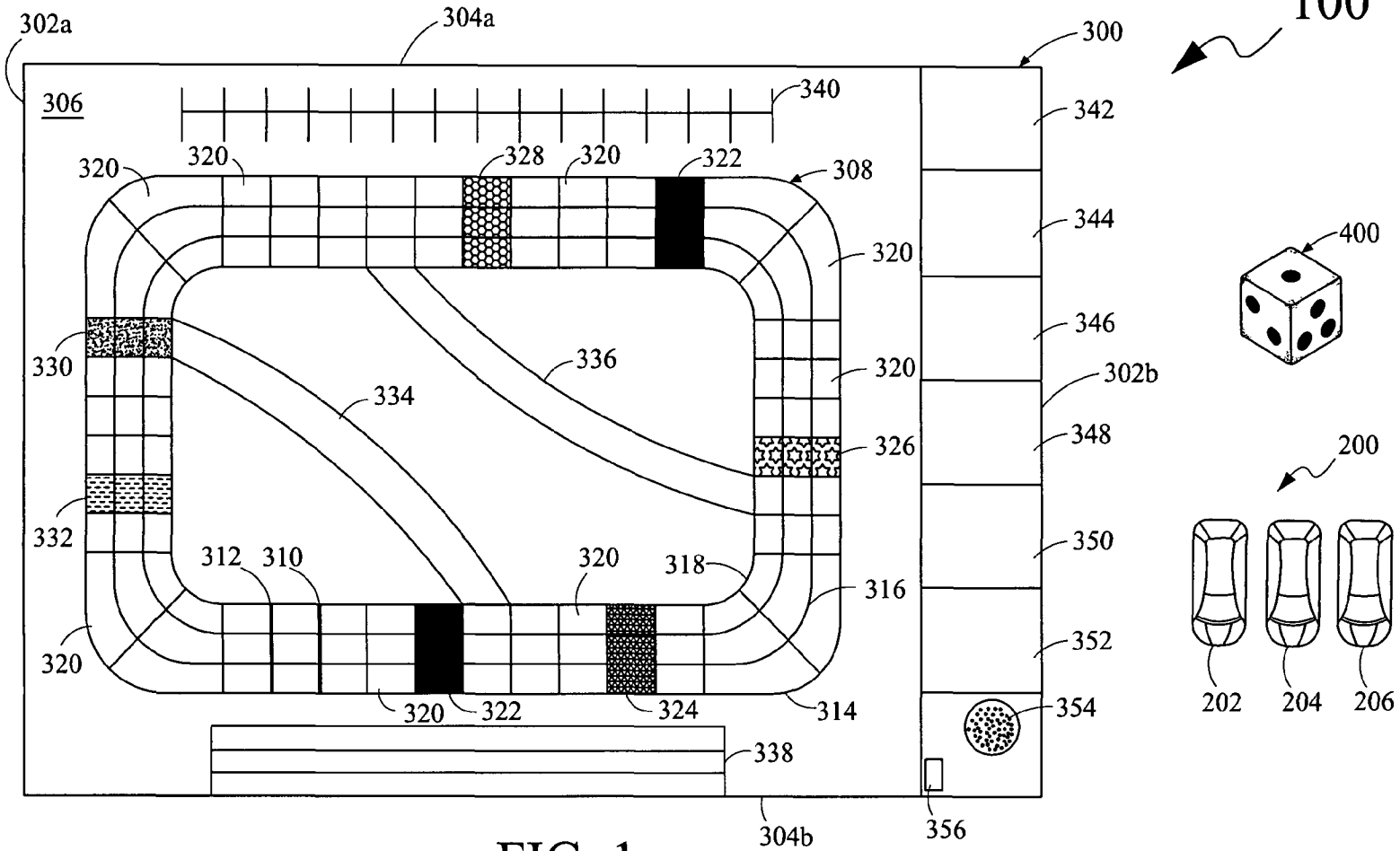
FIG. 1 illustrates a perspective view of an auto racing board game, according to an embodiment of the present invention.

Referring to FIG. 1, a perspective view of an auto racing board game 100 is illustrated, according to an embodiment of the present invention. The auto racing board game 100 (hereinafter referred to as game 100) may be played by a plurality of players such that the plurality of players may compete amongst themselves for winning a race simulated by the game 100.

The game 100 includes a plurality of toy cars 200 for representing the plurality of players, a foldable planar member 300, and at least one die 400. The plurality of toy cars 200 may include a toy car 202, a toy car 204, and a toy car 206. However, it will be apparent to a person skilled in the art that the plurality of toy cars 200 may include more or lesser number of toy cars than three toy cars, as illustrated and described herein depending upon the number of players playing the game 100.

As disclosed herein, each of the plurality of toy cars 200, for example, the toy car 202, 204 and 206 may represent a player of the plurality of players, for example, a first player (not shown), a second player (not shown) and a third player (not shown) participating in the game. In an embodiment of the present invention, a player may use his/her own car, such as a National Association for Stock Car Auto Racing (NASCAR®) car or any other toy car representing the player in the auto racing board game.

The foldable planar member 300 (hereinafter referred to as the planar member 300) may be rectangular in shape having a pair of lateral edges, for example, an edge 302*a* and an edge 302*b*, and a pair of longitudinal edges, for example, an edge 304*a* and an edge 304*b*. Further, the planar member 300 is capable of folding along the lateral edges, for example, the edge 302*a* thereof, thereby assuming a folded position. The folded position of the planar member 300 enables convenient portability and storage of the game 100. In an embodiment of the present invention, the planar member 300 is capable of being folded in three folds, thereby reducing substantially to a width of one-third of the original width thereof. For example, in an open position, dimensions of the planar member 300 may be about 16 inches by about 30 inches. Upon folding the planar member 300 along the lateral edges thereof in three folds, the width of the planar member 300 may be reduced to about one third so that the dimensions of the planar member 300 may become about 16 inches by about 10 inches. Further, as disclosed herein, the planar member 300 is assumed to be rectangular in shape. However, it will be apparent to a person skilled in the art that the planar member 300 may assume any other shape apart from a rectangular shape without deviating from the scope of the present invention.

The planar member 300 comprises an upper surface 306 and a lower surface (not shown). The upper surface 306 of the planar member 300 may include a race track 308 imprinted thereon. In an embodiment of the present invention, the race track 308 may comprise closed circuit race track having a start line 310 and a finish line 312. Alternatively, the start line 310 may coincide with the finish line 312. Further, the race track 308 may comprise a plurality of lanes, for example, a lane 314, a lane 316 and a lane 318. For the simplicity of the present description, the plurality of lanes is shown to include three lanes, namely, the lane 314, the lane 316 and the lane 318. However, it will be evident to a person skilled in the art that the race track 308 may include more or fewer lanes than as described and illustrated herein. Each of the plurality of lanes may provide a path for the plurality of toy cars 200, for example, the toy car 202, the toy car 204 and the toy car 206.

Each lane from the plurality of lanes may be divided into a plurality of move spaces. For example, the lane 314 may be divided into move spaces, such as, a move space 320, a move space 322, a move space 324, a move space 326, a move space 328, a move space 330, and a move space 332. One or more move spaces of the plurality of move spaces may be colored in a color of a plurality of distinct colors. For example, the move space 322 of the lane 314 may be colored in red, the move space 324 may be colored in blue, and the move space 326 may be colored in yellow, the move space 328 may be colored in green, the move space 330 may be colored in orange and the move space 332 may be colored in purple. Furthermore, there may a plurality of move spaces in each lane of the plurality of lanes that may be not be colored and are blank, for example, the move space 320.

Each of the distinct colored move spaces may have a unique message written thereon such that a toy car, for example, the toy car 202 of the plurality of toy cars 200 arriving on the move space may follow the message written on the move space. For example, the move space 322, more specifically, the red colored move space 322 (hereinafter referred to as the red move space 322) may read "Shift one position ahead of the lead car," thereby instructing the toy car 202 arriving at the red move space 322 to jump to a move space that is one move space ahead of a leading toy car. Similarly, the move space 324, more specifically, the move space colored in blue (hereinafter referred to as the blue move space 324) may read "Shift back three move spaces," the move space 326 colored in yellow (hereinafter referred to as the yellow move space 326) may read "Blown tire, lose a turn," the move space 328 colored in green (hereinafter referred to as the green move space 328) may read "Shift three move spaces ahead," the move space 330 colored in purple (hereinafter referred to as the purple move space 330) may read "Pit row-arrows will lead you through the other side of the race track," and the move space 332 colored in orange (hereinafter referred to as the orange move space 332) may read "Shift two move spaces ahead". As disclosed herein, the plurality of lanes is shown and described to include six distinct colored move spaces having six distinct messages written thereon. However, it will be apparent to those having ordinary skill in the art that the plurality of move spaces may be colored in any other color having other messages written thereon. Further, the plurality of lanes may have more fewer move spaces than as described and illustrated herein. Further, each lane of the plurality of lanes may comprise duplicate distinct colored move spaces. For example, the lane 314 may include two or more red move spaces 322.

In an embodiment of the present invention, the race track 308 further comprises at least one pit row, for example, a pit row 334 and a pit row 336 imprinted thereon. The pit row 334 may direct a toy car arriving there to the start line 310. Further, the pit row 336 may direct a toy car backwards on a lane. As disclosed herein, the race track 308 is assumed to comprise two pit rows, namely, the pit row 334 and the pit row 336 for the ease of this description. However, the race track 308 may comprise any number pit rows depending upon the complexity of the game 100.

In an embodiment of the present invention, the planar member 300 comprises a spectator stand 338 and a guard rail 340 imprinted on a portion of a second peripheral edge thereof. For example, the spectator stand 338 may be imprinted on a portion of the edge 304*b* of the planar member 300 and the guard rail 340 may be imprinted on a portion of the edge 304*a* of the planar member 300. The spectator stand 338 and the guard rail 340 may imitate a real spectator stand and a real guard rail with regard to a color and pictorial description thereof, thereby beautifying the foldable planar member 300.

Further, the planar member 300 comprises a plurality of distinct colored buttons corresponding to the plurality of distinct colored move spaces. For example, the planar member 300 may comprise a red button 342, a blue button 344, a yellow button 346, a green button 348, an orange button 350, and a purple button 352 corresponding to the red move space 322, the blue move space 324, the yellow move space 326, the green move space 328, the purple move space 330 and the orange move space 332, respectively. In one embodiment of the present invention, the plurality of distinct colored buttons may be configured on a first peripheral edge of the planar member 300.

The planar member 300 further comprises at least one speaker, for example, a speaker 354 operatively coupled to the plurality of distinct colored buttons, such as the red button 342, the blue button 344, the yellow button 346, the green button 348, the orange button 350, and the purple button 352. The at least one speaker 354 is adapted to produce a distinct sound upon pressing each of the plurality of distinct colored buttons. For example, upon pressing the red button 342, the speaker 354 may produce a sound of a crowd cheering. The description of distinct sounds produced by the speaker 354 may be explained further in conjunction with FIG. 2. The game 100 may include a single speaker, such as the speaker 354 or a plurality of speakers. However, for the purpose of description, a single speaker is shown and described here. Further, the at least one speaker may be mounted on the upper surface 306 or the lower surface of the planar member 300. For example, in FIG. 1, the speaker 354 is illustrated to be mounted on the upper surface 306 of the planar member 300.

The planar member 300 further comprises a microcontroller 356 operatively coupled to the at least one speaker such as the speaker 354, and to each of the plurality of distinct colored buttons. The microcontroller 356 is adapted to activate the at least one speaker 354 upon pressing each of the plurality of distinct colored buttons. More specifically, upon pressing a distinct colored button, for example, the red button 342, the microcontroller 356 may activate the speaker 354 to produce a distinct sound corresponding to the red button 342. The production of distinct sounds upon pressing of distinct colored button may further be explained in conjunction with FIG. 2.

With reference to FIG. 1, the game 100 further includes at least one die 400. The at least one die 400 may be used to generate a random number upon rolling the at least one die 400 by a player from the plurality of players. In the present embodiment, the at least one die 400 is a cube having six equal faces. Each face of the at least one die 400 may have at least one indicia or number imprinted thereon. The at least one die 400 illustrated and described herein includes six faces, however, it will be apparent to a person skilled in the art that the game 100 may utilize any other device apart from a six faced die for playing the auto board game without departing from the scope of the present invention. For example, the dice 400 may be a four faced dice having a pyramidal structure.

Figure 2:
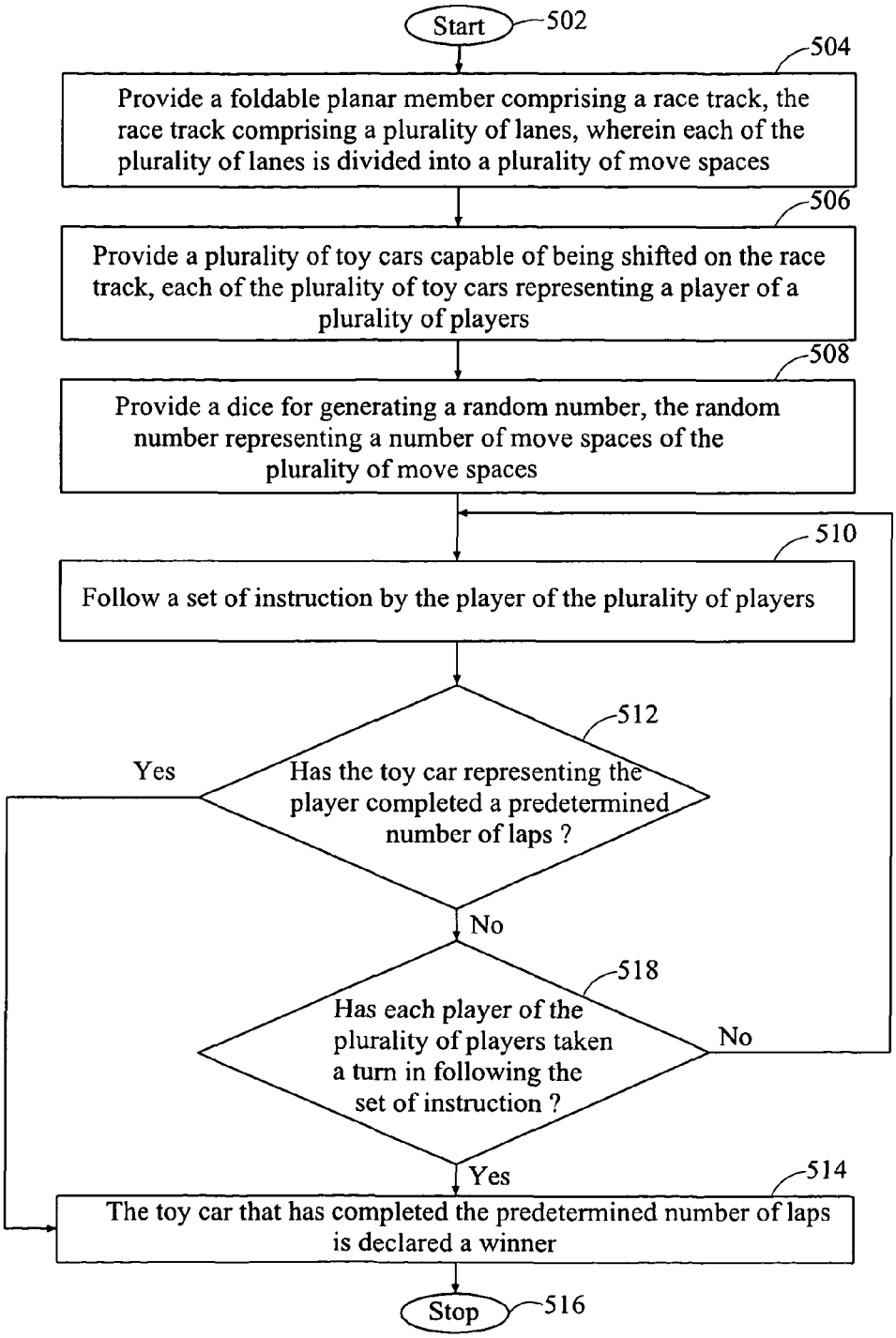
FIG. 2 illustrates a flow chart depicting a method for playing the auto racing board game of FIG. 1, according to an embodiment of the present invention.

FIG. 2 illustrates a flow chart depicting a method for playing the auto racing board game 100 of FIG. 1, according to an embodiment of the present invention. Accordingly, references will be made to FIG. 1 for describing the method for playing the game 100. The method starts at 502. More specifically, the plurality of players, for example, a first player, a second player, and a third player may assemble to play the auto racing board game 100. It will be evident to a person skilled in the art that the plurality of players may include more or lesser number of players than described herein.

At 504, the planar member 300 may be provided to the plurality of players. As described in conjunction with FIG. 1, the planar member 300 comprises the race track 308. Further, the race track 308 comprises the plurality of lanes, such as, the lanes 314, 316, and 318. Further, each of the plurality of lanes, for example, lane 314, is divided into a plurality of move spaces, such as the move spaces 320, 322, 324, 326, 328, 330, and 332. The planar member 300 further includes the plurality of distinct colored buttons corresponding to the plurality of distinct colored move spaces. The plurality of distinct colored buttons may be configured on the first peripheral edge, for example, the lateral edge 302*b* of the foldable planar member 300. Further, the planar member 300 comprises the at least one speaker such as the speaker 354 operatively coupled to the plurality of distinct colored buttons. The at least one speaker 354 is adapted to produce a distinct sound upon pressing each of the plurality of distinct colored buttons.

Furthermore, the planar member 300 comprises the microcontroller 356 operatively coupled to the at least one speaker 354 and to each of the plurality of distinct colored buttons. The microcontroller 356 is adapted to activate the at least one speaker 354 upon pressing each of the plurality of distinct colored buttons. In one embodiment of the present invention, the microcontroller 356 may be programmed to enable the speaker 354 to produce other distinct sounds apart from the distinct sounds disclosed herein.

At 506, the plurality of toy cars 200 may be provided to the plurality of players. For example, the toy cars 202, 204, and 206 may be provided to the first player, the second player and the third player respectively. In one embodiment of the present invention, each player may choose a toy car from the plurality of toy cars 200 for representing the player for playing the game 100. For example, a first player may choose a toy car such as the toy car 202. Similarly, the second player and the third player may choose the toy car 204 and the toy car 206, respectively, for representing the plurality of players while playing the game 100. Alternatively, the plurality of players may toss amongst themselves for choosing a toy car from the plurality of toys cars 200. Each of the plurality of toy cars 200 is capable of being shifted on the race track 308.

At 508, a die for generating a random is provided to the plurality of players. The random number represents a number of move spaces of the plurality of move spaces to be shifted by a toy car upon rolling the dice. At 510, a set of instructions is followed, taking turn by each of the plurality of players for determining a winner of the game. The set of instructions comprise rolling the die 400 by a player of the plurality of players for generating a random number.

The set of instructions further comprise shifting a toy car representing the player by the number of move spaces on the at least one lane. More specifically, based on the random number generated by the die, a player, for example the first player may shift the toy car 202 representing the first player on the move spaces. For example, the first player may roll the die 400 for generating a random number such as four on the die. Accordingly, the first player may shift the toy car 202 on a lane such as 314 by four move spaces.

Further, while shifting the move spaces, the toy car may arrive at distinct colored move space. The player may press the distinct colored button corresponding to the distinct colored move space. For example, the toy car 202 may encounter the red move space 322 while shifting the move spaces based on the number generated by the die 400. Accordingly, the first player may press the red button 342. Upon pressing the distinct colored button, the speaker may produce a distinct sound corresponding to the distinct colored button. For example, pressing the red button 342 may produce a sound of "crowd cheering," pressing the blue button 344 may say "your doors are blown up," pressing the yellow button 346 may produce "mechanic" sounds, pressing the green button 348 may produce "great move" sound, pressing the orange button 350 may say "watch me go!" and pressing the purple button 352 may command the player "you are out of gas, fill the tank and catch up." The player may act according to the sound generated by the speaker.

Thereafter, at 512 it is determined whether the toy car representing the player has completed a predetermined number of laps around the race track. The predetermined number of laps may enable the plurality of players to determine a winner of the auto racing board game. More specifically, each player of the plurality of players may be required to follow the set of instructions until the predetermined number of laps around the race track is not completed by at least one player of the plurality of the players. If it is determined at 512, that the player such as the first player has completed the predetermined number of laps around the race track, the player may be declared a winner of the game at 514. Thereafter, the method terminates at 516.

However, if it is determined at 512, that the player such as the first player has not completed the predetermined number of laps around the race track, then the die 400 may be passed to a next player such as the second player. The next player may follow the set of instructions for completing the laps around the race track such as the race track 308. Accordingly, each player of the plurality of players may follow the set of instructions for playing the game. More specifically, at 518, it is determined whether each player of the plurality of players has taken a turn in following the set of instructions. If it is determined at 518 that each player has not taken a turn in following the set of instructions, the set of instruction may be followed by such players at 510. However, if it is determined at 518 that each player has taken a turn in following the set of instructions, the winner of the auto racing board game may be determined based on a predetermined number of laps completed by the toy car around the race track at 514. In one embodiment of the present invention, the toy car that is first to complete the predetermined number of laps around the race track may be declared as the winner of the game. Thereafter, the method terminates at 516.

The auto racing board game and a method of playing thereof as explained herein may be utilized for providing entertainment to a plurality of players, for example, a group of people, friends, members of a family, students, and the like. The plurality of player may compete amongst themselves for winning the auto racing board game, thereby adding fun, enthusiasm and excitement to the game. Moreover, the disclosed auto racing board game is colorful and capable of producing a variety of sounds at appropriate instances while the plurality of players are playing the auto racing board game.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

What is claimed is:

1. An auto racing board game for a plurality of players, the auto racing board game comprising:

a foldable planar member, the foldable planar member comprising a race track imprinted on the foldable planar member, the race track comprising a plurality of lanes, each of the plurality of lanes divided into a plurality of move spaces, wherein one or more of the plurality of move spaces in each of the plurality of lanes is colored in a color of a plurality of distinct colors, a plurality of distinct colored buttons corresponding to the plurality of distinct colored move spaces, the plurality of distinct colored buttons configured on a first peripheral edge of the foldable planar member, at least one speaker operatively coupled to the plurality of distinct colored buttons, the at least one speaker adapted to produce a distinct sound upon pressing a corresponding one of the plurality of distinct colored buttons, and a microcontroller operatively coupled to the at least one speaker and to each of the plurality of distinct colored buttons, the microcontroller adapted to activate the at least one speaker to produce a distinct sound upon pressing a corresponding one of the plurality of distinct colored buttons;

a plurality of toy cars capable of being shifted on the plurality of move spaces, each of the plurality of toy cars representing a player of the plurality of players; and at least one die for generating a random number, the random number representing a number of move spaces of the plurality of move spaces, such that, at least one toy car of the plurality of toy cars is shifted by the number of move spaces on at least one lane of the plurality of lanes.

2. The auto racing game of claim 1, wherein the race track comprises a closed circuit race track having a start line and a finish line.

3. The auto racing game of claim 2, wherein the race track further comprises at least one pit row adapted to direct the at least one toy car to the start line.

4. The auto racing game of claim 1, wherein each of the plurality of distinct colored move space has a unique message written thereon.

5. The auto racing game of claim 2, wherein the foldable planar member further comprises a spectator stand imprinted on a portion of a second peripheral edge of the foldable planar member.

6. A method for playing an auto racing board game for a plurality of players, the method comprising:

providing a foldable planar member, the foldable planar member comprising a race track imprinted on the foldable planar member, the race track comprising a plurality of lanes, each of the plurality of lanes divided into a plurality of move spaces, wherein one or more of the plurality of move spaces in each of the plurality of lanes is colored in a color of a plurality of distinct colors, a plurality of distinct colored buttons corresponding to the plurality of distinct colored move spaces, the plurality of distinct colored buttons configured on a first peripheral edge of the foldable planar member, at least one speaker operatively coupled to the plurality of distinct colored buttons, the at least one speaker adapted to produce a distinct sound upon pressing a corresponding one of the plurality of distinct colored buttons, and a microcontroller operatively coupled to the at least one speaker and to each of the plurality of distinct colored buttons, the microcontroller adapted to activate the at least one speaker to produce a distinct sound upon pressing a corresponding one of the plurality of distinct colored buttons;

providing a plurality of toy cars capable of being shifted on the race track, each of the plurality of toy cars representing a player of the plurality of players;

providing at least one die for generating a random number, the random number representing a number of move spaces of the plurality of move spaces, such that, the at least one toy car of the plurality of toy cars is shifted by the number of move spaces on at least one lane of the plurality of lanes;

following a set of instructions taking turn by each of the plurality of players for determining a winner of the auto racing board game, the set of instructions comprising rolling the at least one die by a player of the plurality of players for generating a random number, shifting a toy car representing the player by the number of move spaces on the at least one lane, pressing a distinct colored button corresponding to the distinct colored move space as the toy car arrives at the corresponding distinct colored move space; and determining the winner of the auto racing board game based on a predetermined number of laps completed by a toy car of the plurality of toy cars around the race track.

7. The method of claim 6, wherein the race track comprises a closed circuit race track having a start line and a finish line.

8. The method of claim 7, wherein the race track further comprises at least a pit row for directing the at least one toy car to the start line.

9. The method of claim 6, wherein each of the plurality of distinct colored move space has a unique message written thereon.

10. The method of claim 6, wherein the foldable planar member further comprises a spectator stand imprinted on a portion of a second peripheral edge of the foldable planar member.

* * * * *